United States Patent [19]

Koch et al.

[11] Patent Number: 4,603,492

[45] Date of Patent: Aug. 5, 1986

[54] INSERT CONTAINER FOR FREEZE-DRYING PLANTS

[75] Inventors: Klaus D. Koch, Bremen; Johann Brunssen, Osterholz-Scharmbeck; Helmut Sieling, Hambergen, all of Fed. Rep. of Germany

[73] Assignee: HAG GF Aktiengesellschaft, Bremen, Fed. Rep. of Germany

[21] Appl. No.: 715,800

[22] Filed: Mar. 25, 1985

[30] Foreign Application Priority Data

Apr. 12, 1984 [DE] Fed. Rep. of Germany ..... 3413856

[51] Int. Cl.[4] ..... F26B 25/10; F26B 5/06; F26B 13/30

[52] U.S. Cl. ..... 34/237; 34/5; 34/92

[58] Field of Search ..... 34/5, 92, 237

[56] References Cited

U.S. PATENT DOCUMENTS 3,247,602 4/1966 Hamilton et al. ..... 34/237

3,401,468 9/1968 Eilenberg et al. ..... 34/237

FOREIGN PATENT DOCUMENTS 29065 of 1913 United Kingdom ..... 34/237

981638 1/1965 United Kingdom ..... 34/5

*Primary Examiner*—John J. Camby

*Attorney, Agent, or Firm*—Basam E. Nabulsi; Lynn I. Grim; Daniel J. Donovan

[57] ABSTRACT

The insert container (1) for freeze-drying plants comprises a plurality of vertical ribs (4) subdividing the insert container (1) into parallel compartments (7). Vapor-pervious tubes (5) extend transversely of and traverse the ribs (4) preferably at about one-third of their height. The tubes (5) communicate with the ambient atmosphere through one or more vapor discharge channels (6) extending parallel to the ribs (4). The water vapor can also be discharged through channels (12) formed between the side walls (3) of adjacent insert containers (1).

3 Claims, 5 Drawing Figures

INSERT CONTAINER FOR FREEZE-DRYING PLANTS

BACKGROUND OF THE INVENTION

The invention relates to an insert container for freeze-drying plants comprising a plurality of vertical ribs subdividing the insert container into parallel compartments for the material to be dried.

Such insert containers are being used in continuous and discontinuous industrial freeze-drying of granular materials, e.g. in the production of freeze-dried coffee extract. The frozen and ground material is filled into the insert containers, the latter are hooked into suspension carriages and introduced into the vacuum tunnel. The suspension carriages are transported through the tunnel intermittently and are placed on the installed heater plates so that the bottoms of the insert containers are in direct contact with the heat exchange surfaces.

A certain minimum drying rate is required under an economical aspect. Owing to the resistance offered by the bed of frozen material to the flow of escaping water vapor, there is the risk of an inadmissibly high pressure rise in the bed, which may cause the material to exceed the triple point which, in turn, results in fusion of the product and collapse of the structure. An inadmissibly high pressure rise is avoided by providing for efficient water vapor discharge.

In a process known from German Pat. No. 1,135,831, the material to be dried is frozen in the form of upright profiled bodies of material, and the compartments formed by the ribs are so dimensioned that there remains a sufficient diffusion gap between the ribs and the profiled bodies of material.

From German Auslegeschrift 1,285,954 an insert container is known in which the material to be dried rests on a water vapor-pervious supporting member so that there remains a space between the container bottom and the container walls on the one hand, and the supporting member on the other hand.

The supporting member communicates with the ambient atmosphere through vent holes in the bottom and in the walls of the insert container so that in this way the water vapor can be discharged.

Moreover, it is known for an insert container subdivided into compartments by parallel ribs to hang a V-screen insert into the compartments for discharge of water vapor. The space between the V-screen insert and the ribs serves to receive the material to be dried. The V-screen insert forms in each compartment a vertical narrow pocket communicating with the ambient atmosphere to discharge water vapor.

In the above described methods for discharging water vapor it is a disadvantage that the heat transfer surface for the material to be dried is reduced. Thus, for instance, with the use of a V-screen the heat transfer function of the tray bottom area is largely eliminated.

The heat transfer from the insert container to the V-screen insert, or to a supporting member, respectively, is low due to limited possibilities of contact with the tray bottom. This soon results in soiling of the V-screen insert or of the supporting member or adhesion of material being dried. Such soiling can be removed only by washing. If soiled insert containers were reused without being cleaned, this would reduce the filling capacity thereof and would drastically impair the drying behavior. Poor and non-uniform drying behavior of food products results in quality losses by partial over-drying, in capacity losses, and in highly non-uniform residual moisture which, in turn, leads to an unnecessarily low average moisture content.

With the use of a V-screen insert or of a supporting member, there is the risk of mechanical deformation with ensuring differences in the rib spacing. The resulting different bed thickness of the material being dried also leads to impairment of the drying behavior and may reduce the filling capacity up to 50 percent. The use of a V-screen leads to very high water vapor flow rates in the region of the upper edge of the V-screen insert, which may result in fluidization of the drying material in said region. As a result, a portion of the drying material is discharged and deposited on the heater plates or in the vacuum tunnel and the condensers. In addition to the losses in material to be dried, there is also a risk of soiling the vacuum tunnel which may impair, for example, also the transfer of heat from the heater plates to the insert containers.

It is the object of the invention to provide an insert container for freeze-drying plants which warrants highly uniform drying of the material.

SUMMARY OF THE INVENTION

This object is realized by vapor-pervious tubes extending transversely of and traversing the ribs.

Preferably the tubes traverse the ribs at about one third of their height.

In order to enable the tubes to discharge the water vapor, they communicate with the ambient atmosphere. The vapor-pervious tubes may be made of metal wire fabric, perforated aluminum sheet or the like. The size of the openings should be so selected that they are substantially smaller than the diameter of the smallest particles of the granular material being dried in order to avoid losses of material. The open area preferably ranges between 20 and 50%, especially between 30 and 45%.

Since the insert containers generally are very wide, they preferably have one or more vapor discharge channels which extend parallel to the ribs and through which the tubes communicate with the ambient atmosphere.

It is also possible to improve the water vapor discharge by providing depressions in the side walls of the insert containers so that the side walls of two adjacent insert containers form a channel. Moreover, both alternatives of discharging the vapor can be realized jointly.

The advantages attainable by the invention especially reside in the mechanical stability. Owing to the fact that the tubes are arranged in the interior of the insert container mechanical damage is avoided in rough continuous operation. The bed thickness of the material being dried is therefore not influenced and is very constant, thus warranting uniform drying of the material in all the compartments.

The material to be dried fills the compartments with the exception of the tubes, and is thus in direct contact with the tray bottom, which ensures efficient heat transfer. Owing to the fact that the material to be dried is filled directly into the compartment, more heat transfer ribs can be provided in a given width of the insert containers without making the space for the drying material too narrow or the filing capacity per insert container too small.

The water vapor discharging tubes are efficiently supplied with heat by way of the multiplicity of contact points in the bores of the individual ribs so as to avoid adhesion of drying material. In order to improve the heat conductivity, the tubes are preferably made of perforated aluminium sheets. In the inert containers of the invention, the material dries very uniformly, i.e. the variation of the residual moisture content is considerably reduced thereby permitting a higher average residual moisture. At the same time this avoids over-drying and improves the quality of the dried product.

With equal outer dimensions, and despite additional ribs, the insert containers of the invention have a filling volume for material to be dried that is 25% larger than that of insert containers with V-screen inserts. Together with the additional heating area this results in a considerable increase in the drying capacity of the freeze-drying plant.

BRIEF DESCRIPTION OF THE DRAWINGS

Examples for the invention will now be explained in more detail hereafter with reference to the drawings in which.

DETAILED DESCRIPTION OF THE INVENTION

Figure 1:
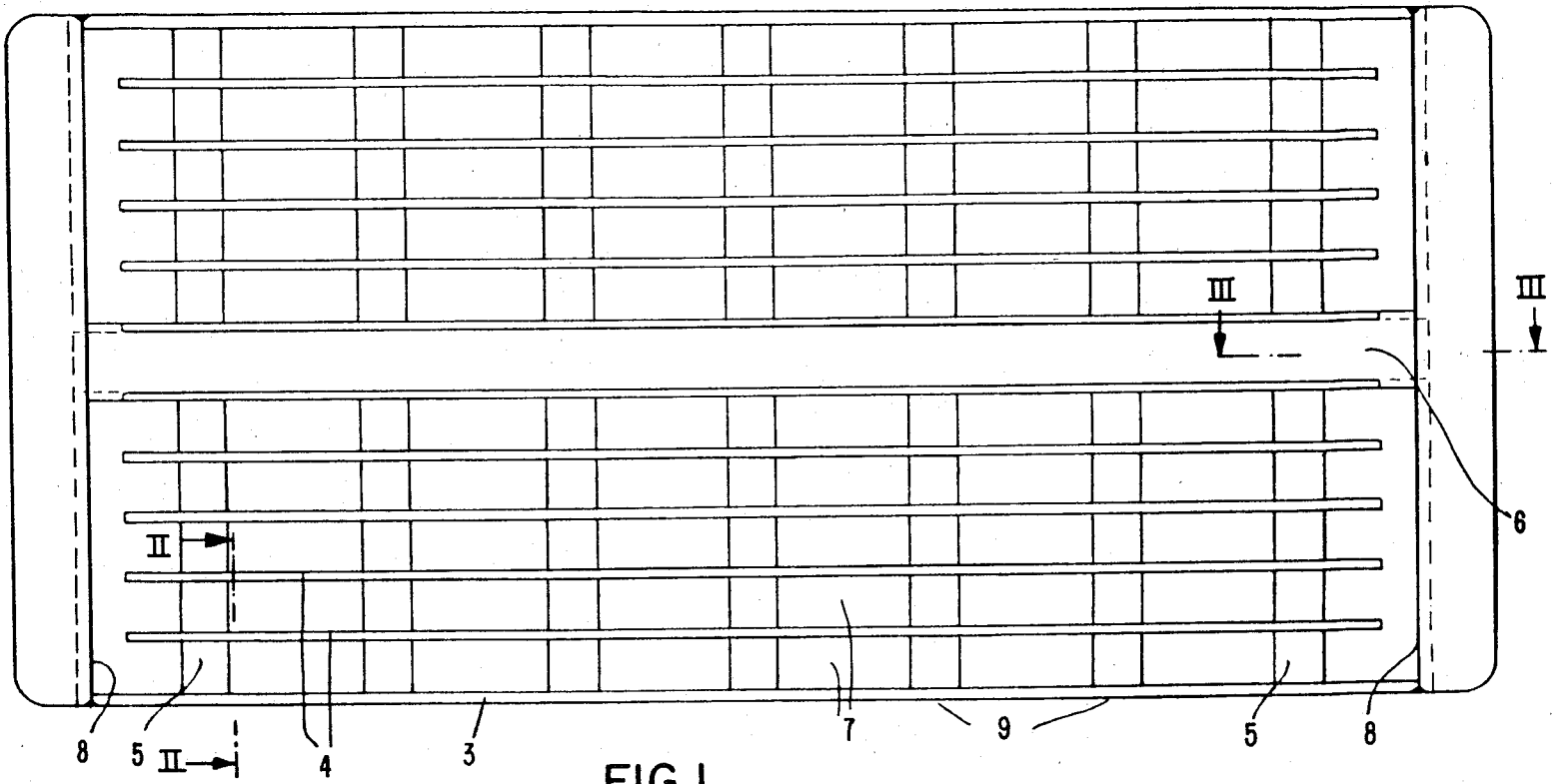
FIG. 1 is a top view of an insert container.
Figure 2:
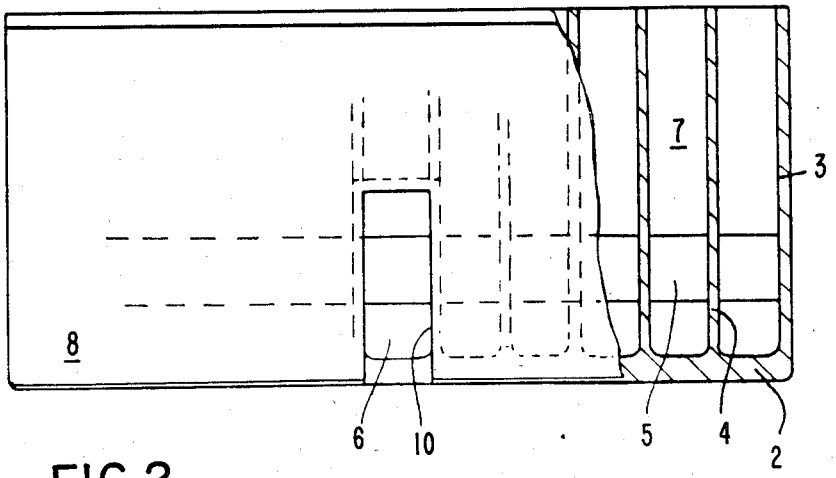
FIG. 2 is a front view of the insert container partially in section along the line II—II in FIG. 1, transversely of the ribs.
Figure 3:
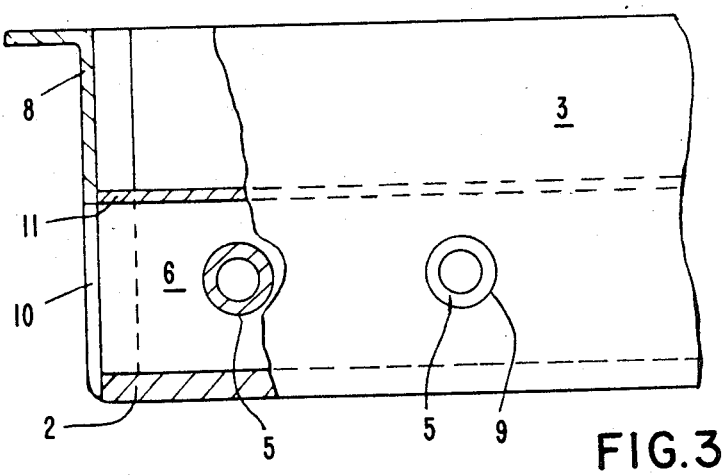
FIG. 3 is a side view of the insert container of FIG. 1, partially in section along a line III—III in FIG. 1, parallel to the ribs.

The insert container 1 illustrated in FIGS. 1 to 3 has a bottom 2, side walls 3, and end walls 8. The end walls 8 are bent outwardly at their upper ends so that the insert container can be hooked in a conveying carriage, not shown. The insert container 1 has the shape of an open-topped tray. In the interior there extend longitudinally parallel ribs 4 leading vertically upwardly from the bottom 2. The ribs 4 form parallel compartments 7 of about 1 to 2 mm width receiving the material to be dried. There may be a small space between the ends of the ribs 4 and the end walls.

The ribs 4 have aligned bores at regular intervals at about one third of their height through which the tubes 5 are inserted. The tubes 5 serve for discharge of water vapor and consist of perforated metal sheet, screen fabric, or a similar foraminous material. In the example shown in the figures, the tubes consist of perforated aluminum sheets of 0.5 mm thickness with 0.75 mm perforations and an open area of 37.4%. The tubes 5 are produced by pressing from corresponding perforated sheet sections. It is possible also to produce the tubes 5 by winding whereby normally a small web remains in the interior of the tubes 5 formed by clamping the metal sheet section into the winding apparatus. However, said web does not cause any trouble. In the side walls 3 the tubes 5 end in openings 9. The openings 9 are not necessary for the discharge of water vapor and only facilitate the insertion of the tubes 5.

In order to improve the discharge of water vapor a longitudinally extending water vapor discharge channel 6 is formed in the middle of the insert container which is likewise traversed by the tubes 5 and communicates with the ambient atmosphere through openings 10 in the end walls 8.

The water vapor discharge channel 6 is formed by two ribs 4 connected by a web 11 above the tubes 5 so as to close the water vapor discharge channel 6 on top. It is also possible to provide a plurality of water vapor discharge channels 6.

All the parts of the insert container 1 including the tubes 5 consist of a material having good heat conducting properties, e.g. of aluminum. The bottom 2, the side walls 3, the ribs 4, and the web 11 are suitably extruded with a ribbed profile. The end walls 8 are suitably welded or soldered to the respective other container parts in the form of aluminum angle plates. The tubes 5 are fitted into matching bores in the side walls 3 and the ribs 4.

Figure 4:
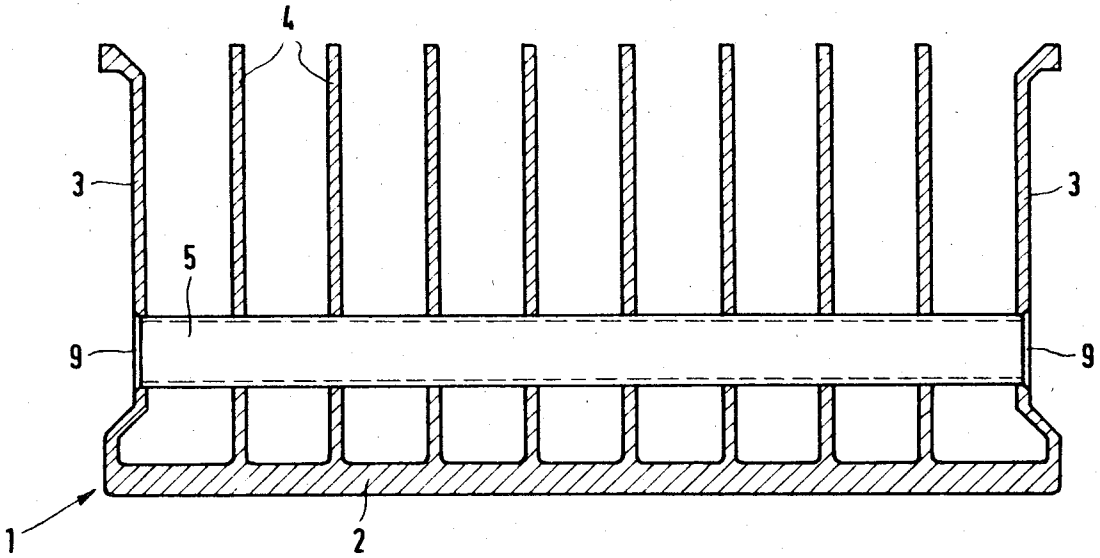
FIG. 4 illustrates another embodiment of the insert container in section transversely of the ribs.
Figure 5:
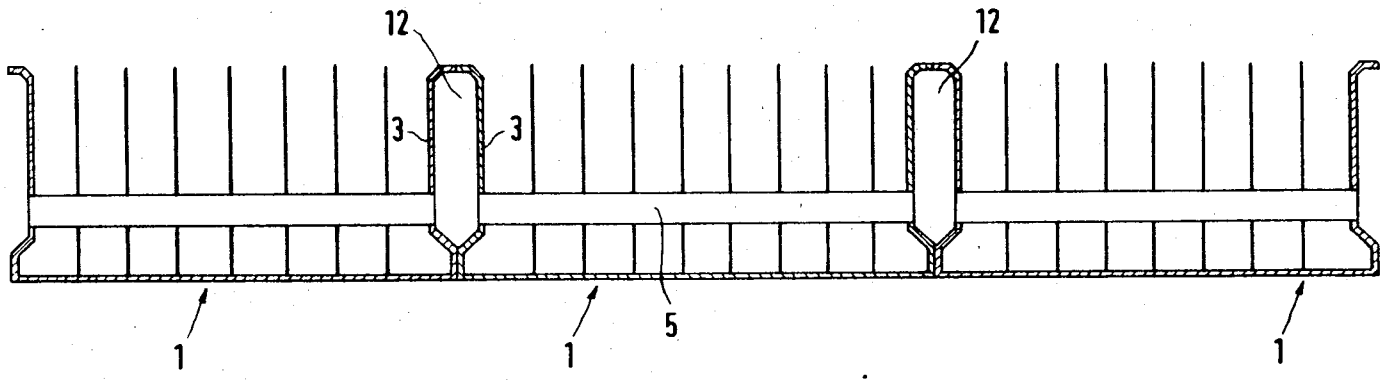
FIG. 5 shows three insert containers of FIG. 4 side by side.

In lieu of the water vapor discharge channel 6, or in addition to the latter, the water vapor can be discharged also through channels formed by the side walls 3, as shown in FIGS. 4 and 5. The side walls 3 are provided for this purpose with a depressed profile so that the side walls 3 of two adjacent suspended insert containers jointly define a channel 12 into which the tubes 5 end. This avoids difficulties in the manufacture of the central channel 6 in the embodiment illustrated in FIGS. 1 to 2.

FIG. 5 shows three such insert containers 1 side by side. The water vapor is discharged through the openings 9 in the depressed side walls 3.

EXAMPLE

The insert container is of the type shown in FIGS. 1 to 3. It has a length of 50 cm, a width of 16 cm, and a height of 7.5 cm. The insert container contains 10 ribs 4 of 2 mm thickness each forming compartments 7 or 1 mm width. The ends of the ribs 4 are spaced from the end walls 8 a distance of 8 mm. The water vapor discharge channel 6 is located in the center of the insert container; it extends in longitudinal direction and has a width of 14 mm and a height of 35 mm.

The bottom 2 with the side walls 3, the ribs 4, and the web 11 is fabricated from extruded aluminum rib profile. The end walls 8 are brazed from inside.

The tubes 5 have an external diameter of 12 mm and consist of perforated aluminum sheet with an open area of 37.4%. The tubes 5 are pushed through the matching bores in the ribs 4 and are fixed by beading in the depressions provided for this purpose around the side wall bores.

We claim:

1. An insert container for freeze-drying plants comprising two opposed end walls (8), two opposed side walls (3) and a plurality of vertical ribs subdividing the insert container into parallel compartments, characterized by:

(a) vapor-pervious tubes (5) extending transversely of the traversing the ribs (4) and (b) one or more vapor discharge channels (6) formed by and extending parallel to said ribs (4) and communicating the tubes (5) with the ambient atmosphere through openings (10) in said opposed end walls (8).

2. Insert container according to claim 1 characterized in that the tubes (5) traverse the ribs (4) at about one third of their height.

3. An insert container for freeze-drying plants comprising two opposed end walls (8), two opposed side walls (3) and a plurality of vertical ribs subdividing the insert container into parallel compartments, characterized by:

(a) vapor-pervious tubes (5) extending transversely of the traversing the ribs (4);

(b) said side walls (3) provided with depressions; and (c) contacting side walls (3) of two adjacent insert containers (1) forming a channel (12) for discharge of water vapor.

* * * * *